United States Patent [19]

Babb

[11] Patent Number: 4,526,023

[45] Date of Patent: Jul. 2, 1985

[54] TUBE FLARING TOOL DIE ASSEMBLY

[75] Inventor: Larry F. Babb, LaGrange, Ohio

[73] Assignee: Emerson Electric Company, St. Louis, Mo.

[21] Appl. No.: 554,539

[22] Filed: Nov. 23, 1983

[51] Int. Cl.[3] ..... B21D 41/02

[52] U.S. Cl. ..... 72/116; 72/125; 72/317; 72/478

[58] Field of Search ..... 72/317, 316, 318, 322, 72/323, 477, 115, 116, 117, 125, 478; 16/226, 16/259, 261, 270, 386

[56] References Cited

U.S. PATENT DOCUMENTS

| | | | |
|---|---|---|---|
| 1,661,367 | 3/1928 | Helminiak | 72/116 |
| 2,180,033 | 11/1939 | Cattoi | 72/116 |
| 2,534,510 | 12/1950 | Franck | 72/116 |
| 2,892,480 | 6/1959 | Franck | 153/79 |
| 3,050,103 | 8/1962 | Janik | 72/117 |
| 3,117,617 | 1/1964 | Meese | 153/81 |
| 3,195,337 | 7/1965 | Janik | 72/115 |
| 3,992,005 | 11/1976 | Richey | 16/169 |
| 4,025,271 | 5/1977 | Wolcott | 425/318 |
| 4,108,589 | 8/1978 | Bunch | 425/393 |

FOREIGN PATENT DOCUMENTS

| | | | |
|---|---|---|---|
| 945547 | 1/1964 | United Kingdom | 16/169 |

*Primary Examiner*—Lowell A. Larson

*Attorney, Agent, or Firm*—Body, Vickers & Daniels

[57] ABSTRACT

A tube flaring tool flare bar assembly is disclosed comprising a pair of elongate parallel flare bars having opposite ends and laterally opposed inner sides provided with cooperable tube supporting recesses. The flare bars are laterally pivotal relative to one another about an axis at a common one of the opposite ends, and resilient retaining spring arrangements interengage the flare bars at the one end for pivotal movement of the flare bars about the axis. The flare bar assembly is adapted to be clampingly supported in a yoke component provided with a displaceable flaring cone by which the end of a tube engaged between the flare bars is flared.

15 Claims, 10 Drawing Figures

TUBE FLARING TOOL DIE ASSEMBLY

BACKGROUND OF THE INVENTION

This invention relates to the art of tube flaring tools and, more particularly, to an improved flare bar assembly for a tube flaring tool.

Tube flaring tools of the character to which the present invention is directed are well known and, basically, include a yoke assembly comprising a yoke body having a window or opening therethrough providing support for a flare bar assembly comprised of a pair of flare bar members having laterally opposed inner sides provided with opposed recesses for supporting a tube to be flared. The flare bar assembly is suitably clamped in place in the yoke window for the tube engaged between the bars to be in coaxial alignment with a flaring cone supported on the yoke body for displacement into engagement with the tube end to achieve flaring of the latter. Following the flaring operation, the flare bar assembly is released and removed from the yoke window, after which the flare bars are laterally separated to release the flared tube therefrom.

Generally, the flare bars of such flare bar assemblies are pivotally interconnected at or adjacent one of the opposite ends thereof for lateral pivotal displacement about a common pivot axis. Such pivotal displacement of the flare bars is between open and closed positions in which the flare bars are respectively positioned to receive and to engage and support a tube to be flared. Heretofore, such pivotal interconnection of the flare bars has required special machining of the ends of the flare bars and/or the use of a pivot pin or pins separate from the flare bars, whereby the flare bar assemblies have been structurally complex, have required the assembly of an excessive number of component parts and, accordingly, have been undesirably expensive. Most often, the ends of the flare bars opposite the pivotally interconnected ends are cooperatively interengaged when the flare bars are closed to maintain alignment of the bars in a plane transverse to the pivot axis. For example, the laterally inner sides of the flare bars can be provided with an interengaging pin and recess arrangement for this purpose. Such pin and recess arrangements, or other arrangements for the same purpose, undesirably add to the expense of the assembly.

Further, flare bar assemblies heretofore provided in which the flare bars are pivotal about a common pivot axis have required the use of a pivot pin arrangement which is either structurally fixed against disassembly of the flare bars from one another, such as shown in U.S. Pat. No. 1,661,367 to Helminiak for example, and/or have required the use of structurally dissimilar flare bar members, as shown in U.S. Pat. No. 3,117,617 to Meese for example. In the first case, the damaging or breaking of one of the flare bar members necessitates replacement of the entire flare bar assembly, and the requirement for structurally dissimilar flare bars not only precludes interchangeability but also requires the production and storage for availability of both parts. These features disadvantageously add to both the production and maintenance or replacement costs with respect to the component parts and the flare bar assembly as a unit.

SUMMARY OF THE INVENTION

In accordance with the present invention, an improved flare bar assembly is provided which is comprised of a pair of flare bar members and a resilient retaining component which interengages with and supports the flare bars for pivotal movement about a common pivot axis. Preferably, the resilient retaining component is removably interengaged with the flare bars, thus enabling disassembly of the latter for maintenance and/or replacement purposes. Still further, the three piece flare bar assembly according to the invention advantageously enables the use of flare bar members which are structurally identical to one another, whereby only one flare bar member structure is required. This promotes a reduction in production costs and enables interchangeability of the flare bars which in turn enables the ready removal and replacement of a damaged or broken flare bar member in a flare bar assembly. Still further, the resilient retaining component interengages with the flare bar members in a manner which promotes alignment therebetween with respect to a plane transverse to the pivot axis, thus avoiding the need for a pin and recess or other interengaging arrangement between the flare bar members at the ends thereof opposite the pivot axis. Each of the foregoing features individually promotes both structural simplicity and a reduction in cost. Collectively, these features enable the provision of a flare bar assembly in which the flare bar members are interchangeable and are readily assembled and disassembled relative to one another, thus promoting efficiency with respect to both production and maintenance or replacement operations.

It is accordingly an outstanding object of the present invention to provide an improved flare bar assembly of the character comprising a pair of flare bars interengaged for relative pivotal movement about a common axis.

Another object is the provision of a flare bar assembly of the foregoing character in which the flare bar members are pivotally interengaged by a resilient retaining component, thus providing a three piece assembly.

Yet another object is the provision of a flare bar assembly of the foregoing character in which the retaining component is removably interengaged with the flare bars, thus enabling the flare bars to be readily assembled and disassembled relative to one another.

A further object is the provision of a flare bar assembly of the foregoing character in which the resilient retaining component interengages with the flare bars to promote alignment therebetween with respect to a plane transverse to the pivot axis.

Still a further object is the provision of a flare bar assembly of the foregoing character in which the flare bar members are interchangeable with one another, whereby only a single flare bar structure is required to provide the assembly.

Yet a further object is the provision of a flare bar assembly of the foregoing character which is structurally simple and economical to produce and in which the component parts are adapted to be readily assembled and disassembled to promote efficiency and thus economy with respect to production and maintenance of the assembly, and in which the component parts when assembled provide a flare bar assembly having structural integrity in connection with its use and its manipulation in use.

BRIEF DESCRIPTION OF THE DRAWINGS

The foregoing objects, and others, will in part be obvious and in part pointed out more fully hereinafter in connection with the written description of preferred embodiments of the invention illustrated in the accompanying drawings in which.

DESCRIPTION OF PREFERRED EMBODIMENTS

Figure 1:
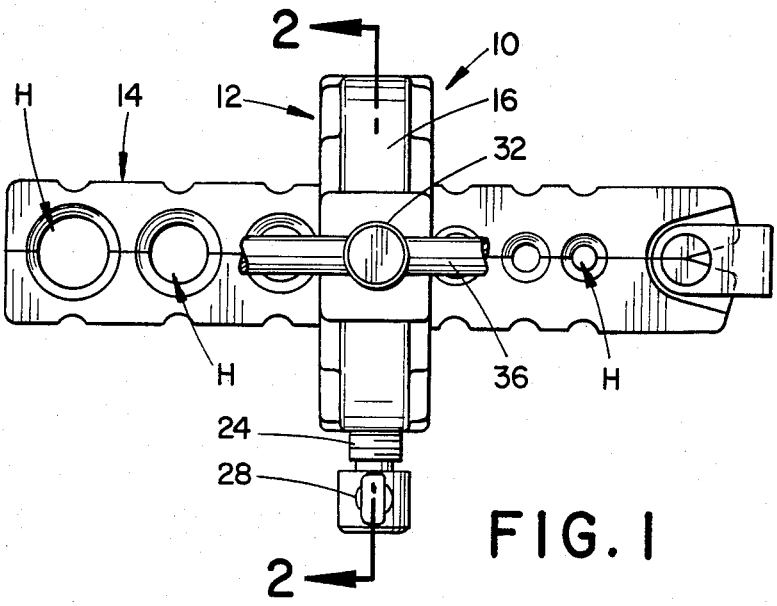
FIG. 1 is a plan view of a flaring tool including a flare bar assembly made in accordance with one embodiment of the present invention.
Figure 2:
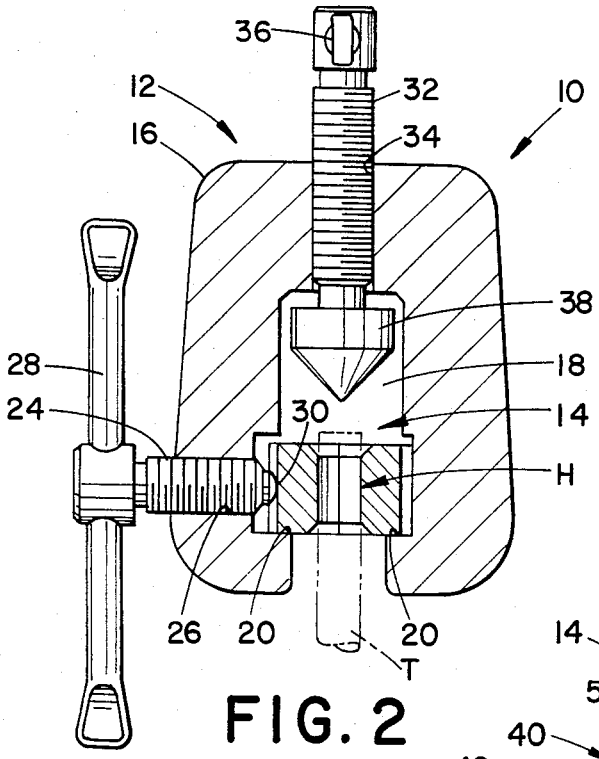
FIG. 2 is a cross-sectional elevation view of the flaring tool taken along line 2—2 in FIG. 1.

With reference now in greater detail to the drawings, wherein the showings are for the purpose of illustrating preferred embodiments of the invention only and not for the purpose of limiting the invention, FIGS. 1 and 2 of the drawing illustrate a tube flaring tool 10 comprising a yoke assembly 12 and a flare bar assembly 14 made in accordance with the present invention. Yoke assembly 12 does not form a part of the present invention and is illustrated in the drawings merely to show the assembled interrelationship between a yoke assembly and flare bar assembly when the latter is associated with the yoke assembly to achieve a tube flaring operation. Accordingly, it will be appreciated that yoke assembly 12 can be of any desired contour and construction suitable for supporting flare bar assembly 14 during a tube flaring operation. Such support is achieved with the yoke assembly illustrated in FIGS. 1 and 2 of the drawing by providing the yoke body 16 with a window or opening 18 including laterally spaced apart and longitudinally extending shoulders 20 adapted to engage under and vertically support flare bar assembly 14. A threaded clamp screw 24 extends through a threaded opening 26 provided therefor in yoke body 16, and a handle 28 on the outer end of screw 24 provides for rotating the screw to laterally displace the inner end 30 thereof relative to window 18 to releaseably clamp flare bar assembly 14 in yoke body 16. A feed screw 32 extends vertically through a threaded opening 34 provided therefore in yoke body 16, and a handle 36 on the outer end of screw 32 provides for rotating the latter to displace a flaring cone 38 on the inner end of the screw into and out of flaring engagement with a tube T supported by the flare bar assembly.

Figure 3:
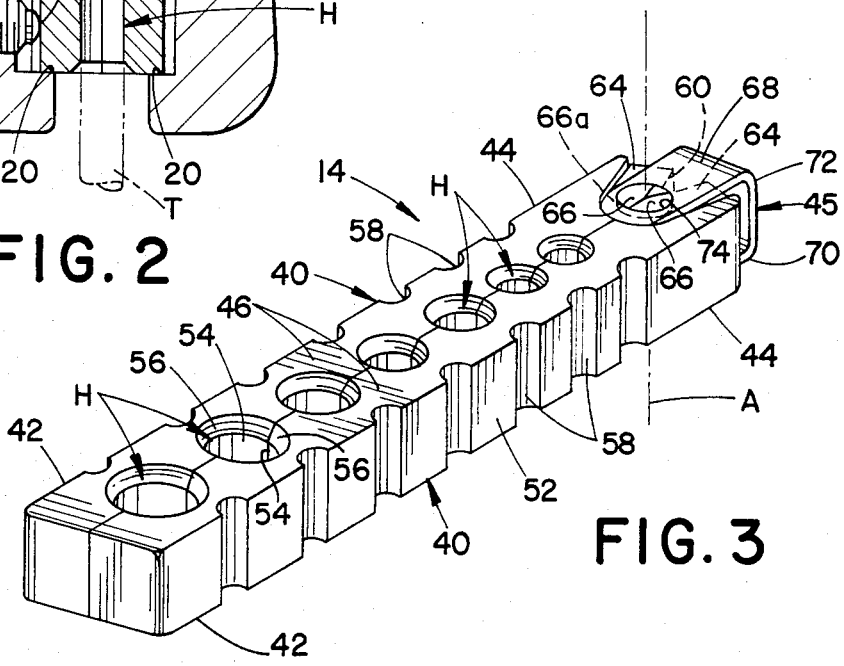
FIG. 3 is a perspective view of the flare bar assembly shown in FIG. 1.
Figure 4:
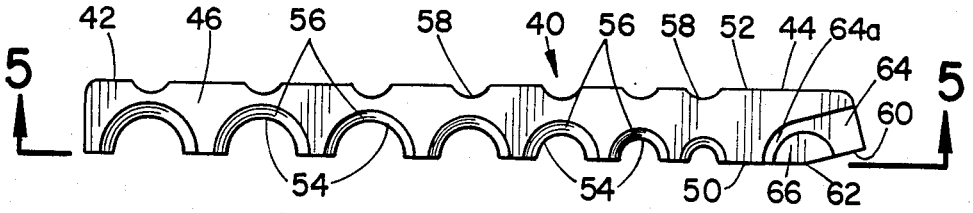
FIG. 4 is a plan view of one of the flare bar members.
Figure 5:
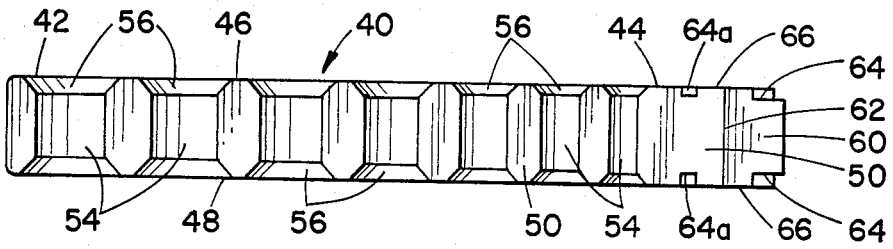
FIG. 5 is an elevation view of the flare bar member shown in FIG. 4 taken along line 5—5 in FIG. 4.
Figure 6:
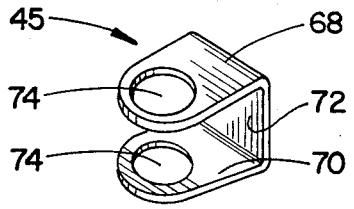
FIG. 6 is a perspective view of the resilient retaining component of the flare bar assembly shown in FIG. 3.
Figure 8:
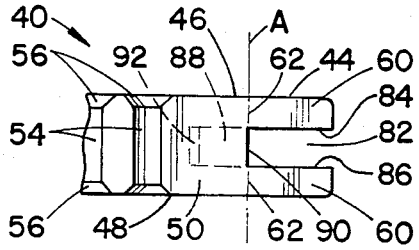
FIG. 8 is an elevation view of a portion of the laterally inner side of one of the flare bars taken along line 8—8 in FIG. 7.

With reference now to FIGS. 3–6 of the drawing, flare bar assembly 14 is comprised of a pair of elongate flare bar members 40 having corresponding opposite ends 42 and 44, and a resilient retaining component 45 interengaging the flare bars at ends 44 thereof in the manner and for the purpose described in greater detail hereinafter. In the embodiment illustrated, flare bars 40 are structurally identical, whereby it will be appreciated that the flare bar 40 shown in FIGS. 4 and 5 is representative of both flare bars. In the orientation of the flare bar assembly and flare bars shown in FIGS. 3–5, each flare bar has an upper side 46, a lower side 48, a laterally inner side 50, and a laterally outer side 52. Laterally inner sides 50 of the flare bars are provided with semicircular recesses 54 spaced apart along the length of the corresponding bar, and the upper and lower ends of recesses 54 are provided with outwardly extending flares 56. When the flare bars are assembled as shown in FIG. 3, recesses 54 in the opposed laterally inner sides of the flare bars cooperatively provided circular or cylindrical holes H for receiving tubing to be flared. The radii of adjacent ones of the recesses 54 in each flare bar are different, whereby the flare bar assembly provides a plurality of openings H of different diameter to accommodate different diameter tubes to be flared. While not shown, the surfaces of recesses in the flare bars can be serrated between the corresponding flares 56 to enhance the gripping of a tube during a flaring operation.

Each of the flare bars 40 is provided with a plurality of arcuate recesses 58 in the laterally outer side thereof, which recesses 58 extend between upper and lower sides 46 and 48 of the flare bar. Further, recesses 58 correspond in number with recesses 54 and are laterally aligned with the corresponding recess for the purpose set forth more fully hereinafter.

In the embodiment illustrated in FIGS. 3–6, ends 44 of the flare bars each include a vertically extending planar wall 60 intersecting the corresponding laterally inner side 50 of the flare bar along a vertical line 62. Lines 62 of the two flare bars provide a common pivot axis A for the flare bars when assembled as shown in FIG. 3. Further, upper side 46 and lower side 48 of each flare bar is provided with a recess 64 having an inner end 64*a* extending around a pivot pin segment 66 which is integral with the flare bar and which has an outer surface planar with the corresponding one of the upper and lower sides of the flare bar. The circumferentially opposite ends of pin segment 66 intersect laterally inner side 50 and wall 60 of the flare bar, and it will be appreciated from FIG. 3 of the drawing that when the flare bars are in assembled relationship, pin segments 66 cooperate to provide pivot pins or posts on the upper and lower sides of the flare bars.

As mentioned hereinabove, flare bars 40 are interengaged by means of resilient retainer component 45. In this embodiment, retainer component 45 is a generally U-shaped sheet metal spring clip member produced from a suitable spring steel and, as will be seen from FIGS. 3 and 6, includes a pair of planar legs 68 and 70 and an integral bridging portion 72 therebetween. Legs 68 and 70 are provided with aligned circular openings 74 having a diameter closely corresponding to that provided by the pairs of pin segments 66 on the upper and lower sides of flare bars 40. Preferably, the thickness of the sheet metal from which retaining component 45 is produced corresponds with the depth of recesses 64 in flare bars 40, and the vertical dimension of bridging portion 72 provides for the inner surfaces of legs 68 and 70 to facially engage a corresponding recess 64 when the retaining component is assembled with the flare bars. It will be appreciated that this provides for the outer sides of legs 68 and 70 to be coplanar with the outer ends of pin segments 66 and the upper and lower sides of the flare bars. Legs 68 and 70 are of a length providing for bridging portion 72 to be slightly spaced outwardly from the terminal ends of flare bars 40 to facilitate pivotal displacement of the flare bars relative to one another and to the retaining component and, preferably, legs 68 and 70 extend from bridging portion 72 in converging relationship relative to one another for the purpose set forth hereinafter.

It will be appreciated from the foregoing description and from the illustration in FIG. 3 that a pair of flare bars 40 can be quickly assembled by positioning the bars in laterally adjacent relationship, axially spreading legs 68 and 70 of the retaining component, introducing ends 44 of the flare bars therebetween, and then releasing the legs for openings 74 therein to receive pin segments 66. It will likewise be appreciated that disassembly is quickly achieved by reversing the foregoing procedure. When the flare bars and retaining component are assembled, the retaining component interengages the flare bars for pivotal movement relative to one another about common axis A between the closed position of the flare bars shown in FIG. 3 and an opening position in which the flare bars are disposed in diverging relationship relative to one another in the direction from ends 44 toward ends 42 thereof. The extent of relative displacement of the flare bars in the opening direction is limited by facial engagement of walls 60 with one another. However, it will be appreciated that such displacement could be limited by appropriately contouring the laterally outer sides of recesses 64 or the laterally opposite side edges of legs 68 and 70 of the retainer component for the legs and recess sides to interengage and limit opening displacement of the flare bars. The spring steel construction of retaining component 45 advantageously promotes alignment between flare bars 40 with respect to a plane transverse to axis A. Such alignment is further promoted by facial engagement between legs 68 and 70 and recesses 64 and by the preferred converging relationship mentioned hereinabove with respect to legs 68 and 70. In this respect, the converging relationship provides for the legs 68 and 70 to exert a biasing force against the assembled flare bars in the direction of axis A.

Flare bars 40 can be of any suitable material, and the provision of pin segments 66 can be provided in any suitable manner, such as by machining the flare bar ends. However, the preferred flare bar structure shown in the drawings advantageously enables a very economic production of the flare bars by a casting process using a suitable powdered metal, for example. Further in this respect, only one mold design is required to produce the flare bars in light of the identical structure thereof. Of further advantage in connection with the structure of the flare bar assembly is the fact that use of the assembly does not require any specific orientation thereof relative to a tube to be flared or to the yoke assembly in which flaring takes place. More particularly in this respect, and as will be appreciated from FIGS. 1 and 2, recesses 58 in the laterally outer sides of flare bars 40 are adapted to receive inner end 30 of clamping screw 24. This provides for a given tube hole H to be longitudinally positioned in alignment with the axis of feed screw 32 and for the flare bar assembly to be laterally clampingly engaged with the yoke body. The provision of flares 56 at both of the opposite ends of each of the tube recesses 54, and the provision of recesses 58 on each of the laterally outer sides of the flare bar assembly and from the upper to the lower side of each flare bar, enables the flare bar assembly to be longitudinally introduced into window 18 of the yoke body in either direction with respect to the window axis, enables either of the opposite ends of the flare bar assembly to be so introduced into the window, and enables either of the upper and lower sides of the flare bars as described herein to be the upper side of the flare bar assembly when positioned in the yoke body. Accordingly, use of the flare bar assembly is facilitated by the fact that a workman need merely open the flare bars, position the end of a tube to be flared in the appropriate recess, and then close the bars to hold the tube in place. This procedure determines which of the upper and lower sides of the flare bar assembly as described herein is to be the upper side in connection with a tube flaring operation. A workman can then quickly and conveniently introduce the flare bar assembly and tube into the yoke assembly from either side thereof and using either of the opposite ends of the flare bar assembly as the leading end in accordance with the support and manipulation of the flare bar assembly which is most convenient for the workman. In the event that one of the flare bars is damaged or broken, thus requiring maintenance or replacement, it will be appreciated that the resilient retaining arrangement facilitates the quick removal of the damaged or broken flare bar from the assembly and the replacement thereof, thus to avoid total loss of the flare bar assembly and to minimize non-productive time with respect to use thereof. Further in this respect, the preferred structure of the flare bars enables the stocking of a single component of the assembly, thus avoiding the cost and space requirements with respect to maintaining an inventory of complete flare bar assemblies or quantities of each of two structurally different flare bars.

While particular emphasis has been placed on certain of the structural features in the embodiment illustrated in FIGS. 1–6, it will be appreciated that a number of these structural features are preferred and not absolutely necessary in connection with achieving interengagement of the flare bars of a flare bar assembly in accordance with the present invention. In this respect, for example, it is of course not necessary to provide laterally outer sides of the flare bars with recesses extending completely between the upper and lower sides thereof, or to provide both ends of the tube hole recesses with flares. With respect to the resilient retaining component and the interengagement thereof with the flare bars, it will be appreciated that the pin segments could extend upwardly and downwardly from the upper and lower sides of the flare bars as opposed to being defined by recesses in the flare bars, whereby the legs of the retaining component would engage the upper and lower sides of the bars as opposed to being coplanar therewith. Further, while it is preferred to provide pin segments integral with the flare bars and an opening therefor in each of the legs of the retaining components, it will be appreciated that the flare bars can be recessed to provide recess segments corresponding in contour to pin segments 66 and that the inner sides of the legs 68 and 70 of the retaining component can be provided with circular pins received in such recesses.

FIGS. 7–10 illustrate component parts of another embodiment of a flare bar assembly in accordance with the present invention. In this embodiment, the flare bars correspond to flare bars 40 of the embodiment illustrated in FIGS. 1–6 except for the arrangement by which the flare bars are pivotally interengaged. Accordingly, like numerals appear in FIGS. 7–10 to identify portions of the flare bars corresponding to those described hereinabove in connection with FIGS. 1–6. Referring now to FIGS. 7–10, flare bars 40 are pivotally interengaged at ends 44 thereof by means of a resilient retaining component 80. More particularly in this respect, ends 44 of the flare bars are provided with longitudinally extending recesses 82 vertically intermediate upper and lower sides 46 and 48 of the flare bars. Each recess 82 has vertically spaced apart upper and lower walls 84 and 86, respectively, each of which laterally intersects and thus vertically divides inner wall 60 and outer side 52 of the flare bar into upper and lower portions. Accordingly, it will be appreciated that each of the upper and lower wall portions 60 intersects laterally inner side 50 of the flare bar along upper and lower lines 62 corresponding to line 62 in the embodiment illustrated in FIGS. 1–6. The longitudinally inner end of recess 82 is contoured to provide a node 88 having a vertically extending edge 90 intersecting the laterally inner side of the flare bar in alignment with lines 62. Accordingly, it will be appreciated that lines 62 and edges 90 cooperatively define common axis A for the assembled flare bars. The longitudinally inner end of recess 82 is further contoured to provide a laterally inwardly extending pocket 92 for the purpose set forth hereinafter.

Figure 10:
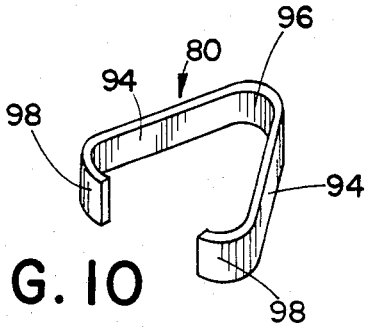
Figure 9:
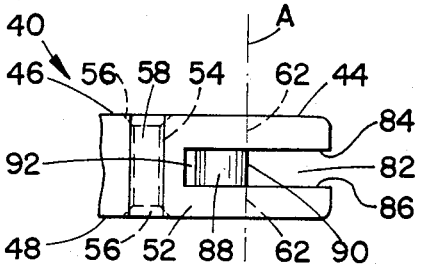
FIG. 9 is an elevation view of a portion of the laterally outer side of the other flare bar taken along line 9—9 in FIG. 7; and, FIG. 10 is a perspective view of the resilient retaining component of the flare bar assembly shown in FIG. 7.

As mentioned hereinabove, flare bars 40 are laterally interengaged for pivotal displacement relative to one another about axis A by means of resilient retaining component 80. More particularly in this respect, as best seen in FIG. 10, retaining component 80 is a generally U-shaped sheet metal clip produced from suitable spring steel to provide a pair of legs 94 interconnected by an integral bridging portion 96 therebetween. The free ends of legs 94 terminate in inwardly extending fingers 98, each of which is received in a corresponding one of the pockets 92 in the flare bars when the retaining component is assembled therewith. In connection with the orientation of the flare bar assembly shown in the drawings, legs 94 have a vertical height closely corresponding to the vertical spacing between upper and lower walls 84 and 86. This provides for the upper and lower edges of legs 94 to interengage with recess walls 84 and 86 when the retaining component is assembled with the flare bars to promote maintaining alignment of the flare bars relative to a plane transverse to axis A. Such interengagement also restrains relative displacement between the flare bars in the direction of pivot axis A. When retaining component 80 is assembled with the flare bars, the laterally innermost ends of fingers 98 can engage the laterally inner ends of pockets 92 to support the flare bars against lateral separation, or the junctures between legs 94 and fingers 98 can engage against node 88 adjacent the entrance ends of pockets 92 for the same purpose. In either event, the lateral spacing between fingers 98 or the intersections thereof with legs 94, in the unmounted disposition of the retaining component, is preferably less than the lateral distance between the surfaces of the flare bars engaged thereby, whereby the retaining component exerts a biasing force laterally inwardly of the flare bar members and thus in a direction transverse to pivot axis A.

Figure 7:
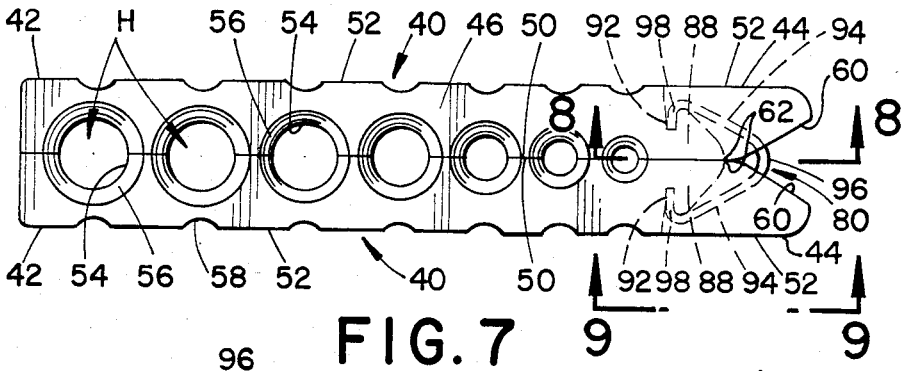
FIG. 7 is a plan view of a flare bar assembly in accordance with another embodiment of the invention.

In use, it will be appreciated that retaining member 80 constrains the flare bars to pivot about common axis A in response to relative displacement therebetween in the direction laterally outwardly from the closed position of the flare bars shown in FIG. 7. It will be further appreciated that such pivotal displacement is against the biasing force of the retaining component, whereby the latter biases the flare bars toward the closed position thereof. This biasing force facilitates the support of a tube in one of the tube holes H during manipulation of the flare bar assembly into position in a yoke assembly, the extent to which such support is facilitated being dependent on the magnitude of the biasing force. The resilient retaining component of this embodiment also enables relative longitudinal displacement between the flare bars which provides for the recesses 54 in the inner sides of the flare bars to be self-aligning with respect to a tube upon closure of the flare bars to capture the tube therebetween.

Flare bars 40 in the embodiment shown in FIGS. 7–10 are readily interengaged with one another by pushing the open end of retaining component 80 longitudinally into recesses 82, whereby legs 94 are progressively displaced outwardly by engagement with the walls of nodes 88 until fingers 98 pass the entrance to pockets 92, whereupon the resilient bias of the retaining component displaces the legs and thus fingers 98 inwardly of pockets 92. The contour of retaining component 80 preferably provides for bridging portion 96 to be exposed in the space between walls 60 of the flare bars to facilitate disassembly through the use of an appropriate tool to relatively spread legs 94 to disengage at least one of the fingers 98 from the corresponding pocket 92.

While considerable emphasis has been placed on certain of the structural features of the retaining component and flare bars in connection with the embodiment illustrated in FIGS. 7–10, it will be appreciated that modifications in the specific structures shown can be made while still providing the desired interengaged relationship between the flare bars. In this respect, for example, while it is preferred to provide for the retaining component to be dimensionally within the confines of the flare bars so that the flare bar assembly is of uniform width and height throughout its length, the retaining component could be designed for the free ends of the legs thereof to engage recesses in the laterally outer sides of the flare bars and between the upper and lower sides thereof with the portion of the retaining component intermediate the opposite ends thereof extending longitudinally of the outer sides of the flare bars and laterally across the longitudinally outermost extremities of ends 44 of the flare bars. As a further example of such modifications, the recess and node configuration for the retaining component could be provided in the form of recesses extending inwardly from each of the upper and lower sides of the flare bars, less than half the vertical distance therebetween, and the retaining component would have two sets of legs 94 and fingers 98 vertically spaced apart and interconnected by a common bridging portion. In such a modification, the portions of the flare bars vertically intermediate the recesses in the upper and lower sides thereof would be captured between the vertically spaced apart sets of legs of the retaining component. These and other modifications will be obvious from the foregoing description of the preferred structure illustrated in FIGS. 7–10.

As many possible embodiments of the present invention may be made, and as many possible changes may be made in the embodiments herein illustrated and described, it is to be distinctly understood that the foregoing descriptive matter is to be interpreted merely as illustrative of the present invention and not as a limitation.

Having thus described the invention, it is claimed:

1. A tube flaring tool flare bar assembly comprising a pair of elongate parallel flare bars having opposite ends, laterally opposed inner sides, coplanar upper sides and coplanar lower sides, said flare bars being laterally pivotal relative to one another about an axis at a common one of said opposite ends and between open and closed positions, said axis being transverse to the planes of said upper and lower sides, recesses in said opposed inner sides cooperable to support a tube to be flared when said flare bars are in said closed position, and resilient retaining means, said retaining means interengaging said flare bars at said one of said opposite ends to alone support said flare bars with said upper and lower sides coplanar and for pivotal movement of said flare bars relative to one another about said axis between said open and closed positions.

2. The flare bar assembly according to claim 1, wherein said resilient retaining means is a spring clip member removably interengaged with said flare bars.

3. The flare bar assembly according to claim 1, wherein said flare bars have laterally outer sides and said resilient retaining means is U-shaped spring clip means having spaced apart legs, said flare bars being positioned between said legs, and said legs exerting a biasing force on said flare bars laterally inwardly with respect to said outer sides.

4. The flare bar assembly according to claim 1, wherein said resilient retaining means is U-shaped spring clip means having spaced apart legs transverse to said axis, said upper and lower sides of said flare bars being positioned between said legs, and said legs exerting a biasing force against said upper and lower sides.

5. The flare bar assembly according to claim 1, wherein said retaining means is U-shaped spring clip means having spaced apart legs, said upper and lower sides being positioned between said legs, and each said legs and the corresponding one of said upper and lower sides including axially interengaging pin and opening means pivotally interconnecting said flare bars and retaining means.

6. The flare bar assembly according to claim 5, wherein said legs exert a biasing force against said upper and lower sides of said flare bars.

7. The flare bar assembly according to claim 5, wherein said pin and opening means includes pin means on said upper and lower sides of said flare bars and openings in said legs receiving said pin means.

8. The flare bar assembly according to claim 7, wherein said upper and lower sides of said flare bars are recessed to provide said pin means.

9. The flare bar assembly according to claim 8, wherein said pin means have outer ends coplanar with the corresponding one of said upper and lower sides of said flare bars, and said legs of said spring clip means have axially outer sides coplanar with said outer ends of said pin means.

10. The flare bar assembly according to claim 8, wherein said legs exert a biasing force against said upper and lower sides of said flare bars.

11. The flare bar assembly according to claim 10, wherein said pin means have outer ends coplanar with the corresponding one of said upper and lower sides of said flare bars, and said legs of said spring clip means have axially outer sides coplanar with said outer ends of said pin means.

12. The flare bar assembly according to claim 1, wherein said one ends of said flare bars have laterally outer sides and said retaining means is U-shaped spring clip means having spaced apart legs, said legs having ends interengaging said flare bars in the direction laterally inwardly of said laterally outer sides.

13. The flare bar assembly according to claim 12, wherein said spring clip means exerts a biasing force laterally inwardly against said laterally outer sides.

14. The flare bar assembly according to claim 12, wherein said one ends of said flare bars have recesses extending laterally inwardly from said laterally outer sides, each of said recesses having spaced apart opposed walls parallel to said upper and lower sides of said flare bars, portions of said legs of said spring clip means including said ends of said legs being in said recesses, and said portions of said legs having opposite edges engaging said opposed walls of said recesses to support said flare bars against relative displacement transverse to the planes of said upper and lower sides.

15. The flare bar assembly according to claim 14, wherein said spring clip means exerts a biasing force laterally inwardly against said laterally outer sides.

* * * * *